United States Patent [19]

Searle et al.

[11] 4,084,677

[45] Apr. 18, 1978

[54] COIN VALIDATOR MODIFICATION

[75] Inventors: Brian Christopher Searle, Staines, England; Glenn Richard Ritter, West Allenhurst, N.J.

[73] Assignee: Cubic Tiltman Langley Limited, Redhill, England

[21] Appl. No.: 694,459

[22] Filed: Jun. 9, 1976

[30] Foreign Application Priority Data

Apr. 8, 1976 United Kingdom ..... 14358/76

[51] Int. Cl.[2] ..... G07F 3/02

[52] U.S. Cl. ..... 194/100 A; 194/97 R

[58] Field of Search ..... 194/97 R, 100, 100 A; 209/81 A, 81 R; 73/163

[56] References Cited

U.S. PATENT DOCUMENTS

| | | | |
|---|---|---|---|
| 2,335,369 | 11/1943 | Wallin | 194/100 R |
| 3,739,895 | 6/1973 | Fougere et al. | 194/100 A |
| 3,933,232 | 1/1976 | Searle et al. | 194/100 A |
| 3,980,168 | 9/1976 | Knight et al. | 194/100 A |
| 3,984,307 | 10/1976 | Kamentsky et al. | 209/74 |

FOREIGN PATENT DOCUMENTS

| | | | |
|---|---|---|---|
| 765,071 | 1/1957 | United Kingdom | 194/100 A |

*Primary Examiner*—Robert B. Reeves
*Assistant Examiner*—Joseph J. Rolla
*Attorney, Agent, or Firm*—Shapiro and Shapiro

[57] ABSTRACT

A single chute, multi-denomination, electronic coin validator having a solenoid operated coin stop positioned upstream of a coin denomination detector, together with a sensor, so that a coin is brought to rest on the coin stop and then released to go on past the detector in response to a solenoid actuating signal. The latter is produced after an interval sufficient to allow the coin time to stop bouncing on the stop and is derived from a signal produced by the sensor. The sensor signal is also used to produce a further signal to act as a timing signal determining the period of the validation test.

8 Claims, 12 Drawing Figures

Ch·H
24·1
33
31·5
31
39
38
BS
CS2·11
24·13
24·12
50·1
49·1
2
5
48
3
10
49·2
SP
CS
6·2
7·2
54·2
11
51·2
52·2
MB3
PM
53·2
14
14·2
F1
16
LED 3
MB1
LED 1
LED 2
14·1
6
LED 4
LW
49
Ch·2
6·1
7·1
52·1
53·1
51·1

Ch H
24·23
31·5
X
5
3
4
1
49·2
50·2
Sd2
25
Sd1
16
CCH
19
18
6
7
42 CG
Sig 3
42·1
41
Sd3
Ph·4
Ch·1
MB4
42·2
40
LW
LED 4
RC

COIN VALIDATOR MODIFICATION

The present invention relates to an electronic coin validator.

The present invention is an improvement in or modification of the invention described and claimed in U.S. Specification No. 3,933,232 of the present Applicants and filed on June 17, 1974 under the title COIN VALIDATOR. A coin denomination detector is employed to generate a transient signal of an amplitude dependent on the denomination of the coin detected. The signal is applied to each of a plurality of window-type comparators corresponding respectively to the valid coin denominations to cause one of them, or more than one of them sequentially, to be operated to produce an output signal; and a control signal is generated at the peak of the detector signal so that a coin of a valid denomination must give rise to the control signal at substantially the same time as the comparator, corresponding to that denomination, is operated by the detector signal. The test of validity is, therefore, the coincidence of two signals, namely, the control signal and an output signal from a comparator.

It is an object of the present invention to provide an improved electronic coin validator of the type described above.

In the present invention, immediately upstream of the coin-denomination detector, is located a stop member normally positioned to extend across the coin chute and stop a coin inserted therein so that the falling coin is first steadied and then held stationary by the stop member. A coin sensor is located by the stop member to sense a coin as it falls onto the stop member and provide a signal indicating the fact; and the signal is used, after a delay calculated to be sufficient to permit the coin time to stop bouncing on the stop member, to generate what may be called a blocker signal to cause the stop member to be withdrawn from the coin chute and permit the coin to fall past the coin-denomination detector, and then return the stop member to its former position.

The signal is also used to generate an operating signal to set up the circuit from a quiescent condition ready to carry out a validation test as above described.

By means of the present invention, the passage of coins of any given size past the coin-denomination detector, both as to speed and position in the coin chute, is rendered consistent and, consequently, the signal produced by the detector is much more strictly related to the coin denomination than would otherwise be the case.

The present invention may also employ a further stop member arranged to work in anti-phase with the first-mentioned stop member (hereinbelow called the first stop member) so that if, when a coin has been inserted in the coin chute, another is inserted before the first coin is released by the first-stop member, the second coin is held by the further stop member when the first coin is released and for as long as the first stop member is withdrawn from the coin chute. The further stop member thus prevents the second coin from interfering with the test of the first coin and permits a definite interval to be employed in testing each coin regardless of how quickly a number of coins are inserted in the coin chute. This permits simplication of the circuit of the validator but without limiting the rate at which coins may be inserted in the coin chute. When the test interval has terminated, the circuit may, therefore be returned to its quiescent condition, and this may be effected by making the operating signal of a time duration to serve as a timing signal defining the test period, and using the termination of the signal to return the circuit to its quiescent condition.

As with the conventional validator described above, the present invention employs a coincidence of a control signal generated at the peak of the detector signal, and an output signal from a comparator as the test of validity. It may also employ, however, as an additional criterion of validity, a coin diameter test by providing a plurality of coin sensors spaced apart in the coin chute so that coins of different diameters differently affect the sensors. For instance, the sensors may be arranged so that the coin of the smallest diameter of coins of, say, three sizes, fails to operate any of the sensors, the coin of next larger diameter operates one of the sensors and the largest coin operates two of the sensors; the circuit providing a logic to determine whether the sensor or sensors, if any, which have been operated correspond to the coin whose validity is otherwise indicated by the circuit and to cause the coin to be rejected if there is no correspondence.

The present invention may also employ a coin chute having a wall thereof movable so that by movement of the wall the coin chute can be widened to release coins which have become jammed side-by-side in the chute. The wall may be so moved by a lever which may be resiliently biassed normally to assume a rest position and which may be located to be accessible at the exterior of the validator. The lever may be used also to operate a switch in the validator circuit so that, whenever the lever is moved from its rest position, the switch is operated to connect the circuit to a source of potential such as to inhibit operation of the circuit. The movable wall of the coin chute may be formed with a member which is latched by the lever in its rest position to hold the wall against movement for as long as the lever remains in the rest position. This prevents movement of the wall otherwise than by operation of the lever, for instance, by the jamming of coins in the coin chute.

The coin denomination detector may comprise a tansformer the primary and secondary coils of which are located in or by the coin chute so that the coin, in passing down the chute, passes the coils and varies the transfer of energy between the primary and secondary coils in dependance on the size and composition of the coin. In the circuit of the validator of the present invention, a reference voltage may be derived from the secondary coil in the quiescent condition of, the circuit for the purpose of biassing the window comparators to operate at voltage levels corresponding to the respective coin denominations; and, so that during a coin test the signal from the secondary coil does not affect the reference voltage, the latter is developed across a capacitor the charge on which is held and isolated from the secondary coil during a coin test. The capacitor may be thus isolated by an analogue switch operated to switch to the off condition and isolate the capacitor by said operating signal.

A further reference voltage from the secondary coil is also applied to the comparators otherwise than through the analogue switch so that, in the quiescent condition of the circuit, each comparator provides no output signals, but so that, when a signal is developed in the secondary coil in detection of a coin, the signal is imposed on the further reference voltage to cause the comparator, or comparators in sequence, whose voltage levels are equal to or less than the peak amplitude of the signal, to switch to produce an output signal. On completion of a coin test, the termination of said timing signal is used to reset the analogue switch, which, in this condition may provide a voltage output to inhibit generation of the control signal.

The above arrangement has the advantage of providing a stable relationship between the reference voltages and consequently of avoiding spurious operation of a comparator.

The blocker signal may also be used in the circuit as an inhibit signal so that stray voltages occurring outside the period of the peak of the signal from the coin-denomination detector but within the period of the operating signal, cannot produce a control signal.

The present invention will now be described by way of example only, with reference to the accompanying drawings in which.

Figure 1:
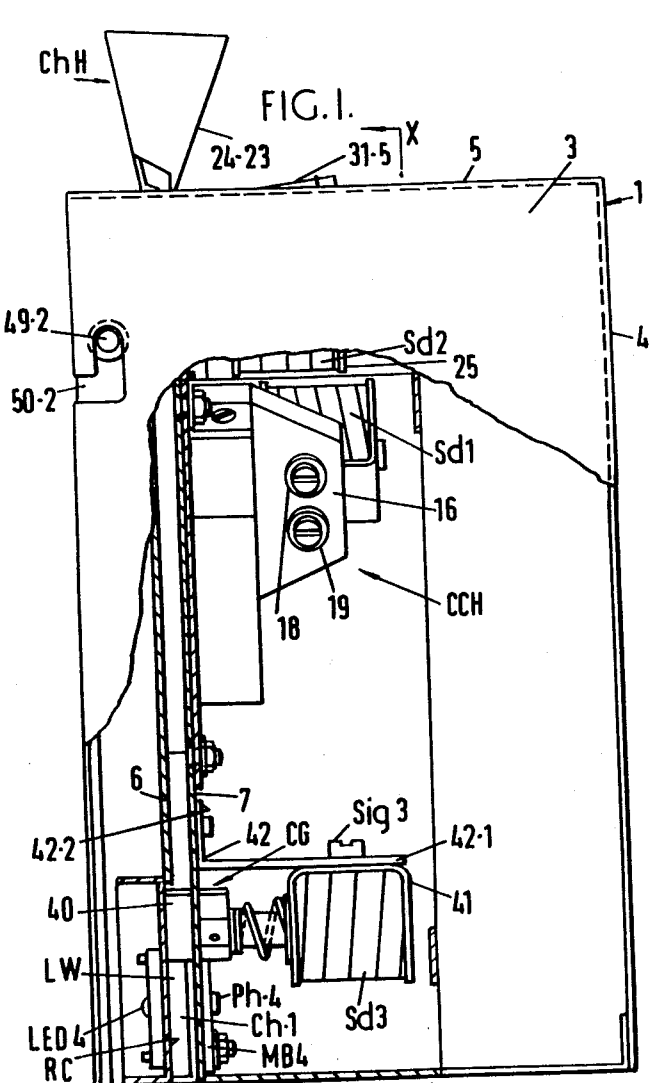
FIG. 1 is a side elevation of a presently preferred embodiment of a coin validator device of the present invention, partly sectioned and with parts removed or broken away to show underlying detail.

Referring now to the drawings, the embodiment comprises a casing 1, consisting of sidewalls 2, 3, rear wall 4 and top wall 5, serving to house the coin chute mechanism generally indicated at CCH (FIG. 1) and the electronic circuit of the validator of the embodiment.

Figure 4:
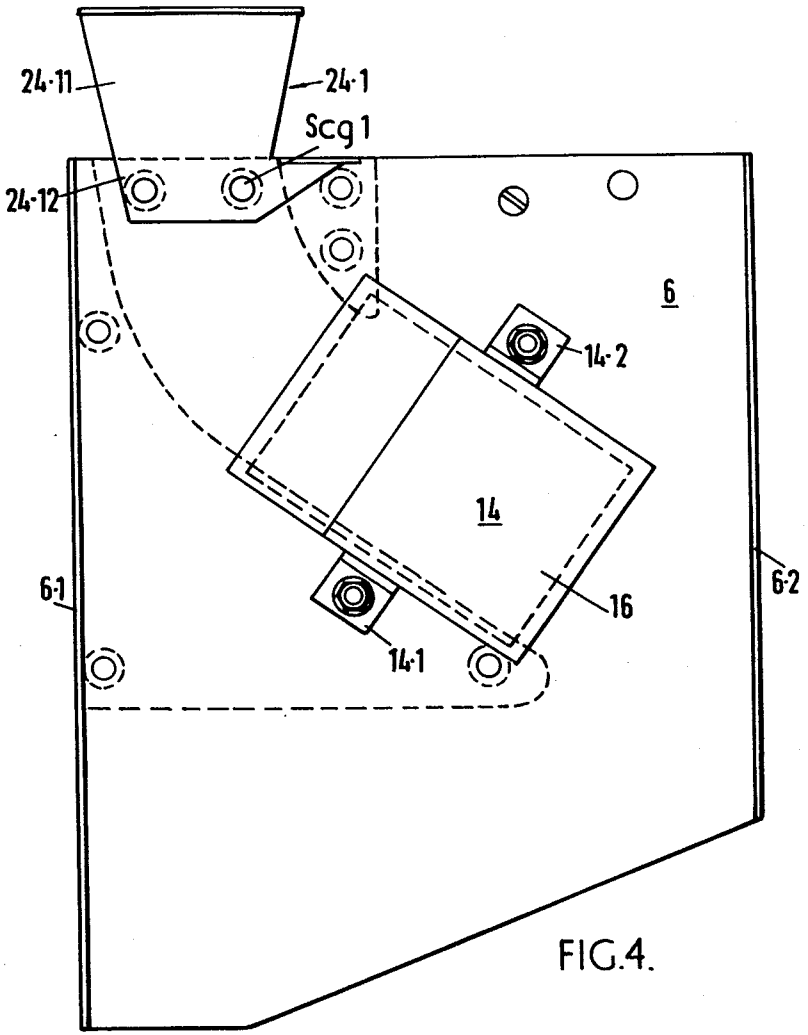
FIG. 4 is a front elevation of a front plate of the device of FIG. 1.

The coin chute mechanism CCH comprises a coin chute Ch formed with two plates, a front plate 6 (FIG. 4) and a rear plate 7 (FIG. 6) each having upstanding lateral walls, namely, 6.1, 6.2 in respect of the front plate and 7.1, 7.2 in respect of the rear plate, so that each plate is U-shaped in section. The rear plate is somewhat wider than the front plate (FIG. 2) which seats within the rear plate and is secured thereto at the lateral wall 6.2 by two bolts 10, 11, passing through aligned bores (not shown) in the respective side walls 6.2 and 7.2 of the front and rear plates. Each bolt is transversely bored at its free extremity to receive a split pin SP and carries on the shank of the bolt, a coil spring CS. Each coil spring abuts at one end against the respective split pin and at the other end against the inner surface of the lateral wall 6.2 of the front plate 6, and is held captive in this manner on the shank of the respective bolt under compression. The bores through which the bolts pass in the lateral wall 6.2 of the front plate 6, are of a sufficient diameter to permit the front plate to turn bodily on the bolts so that the bolts effectively serve as hinges to permit the front plate to be swung away from the rear plate through a small arc; the coil springs being further compressed in such movement and providing a resilient bias thereagainst.

Figure 5:
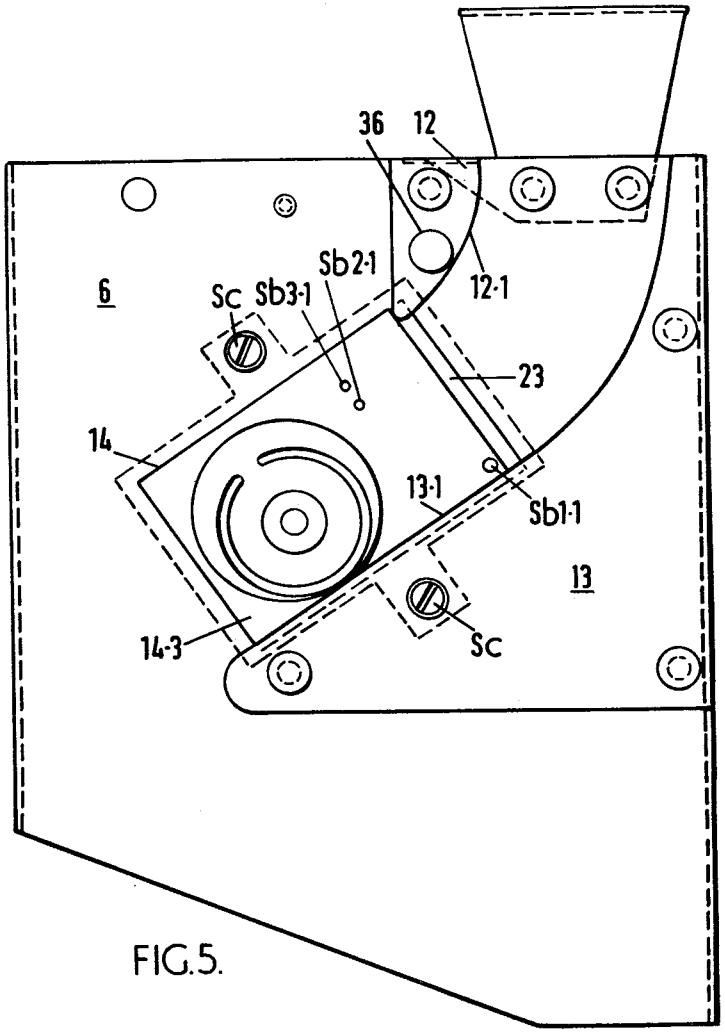
FIG. 5 is a rear elevation of the plate of FIG. 4.
Figure 8A:
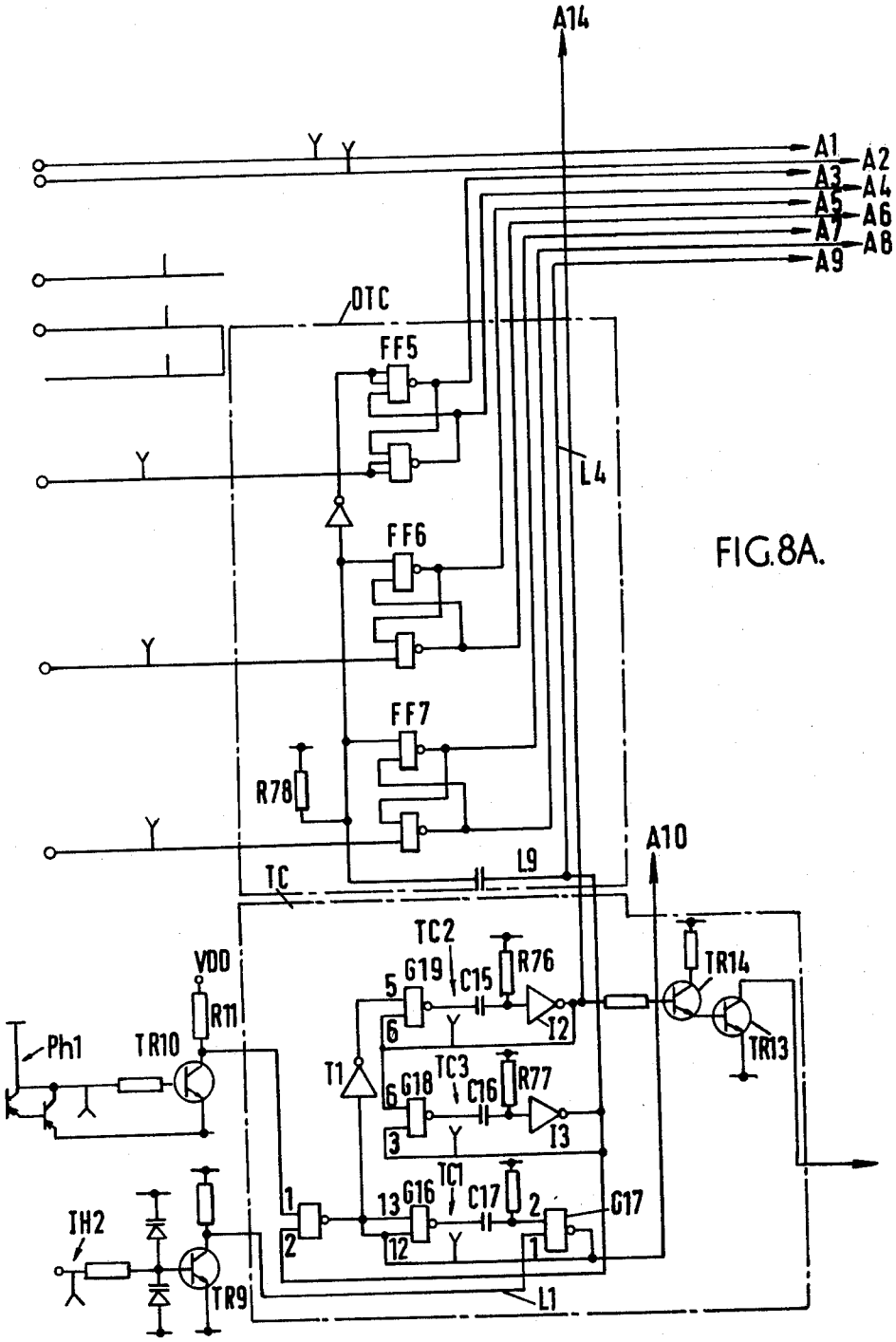
FIG. 8 is a diagram of the circuit of the device of FIG. 1 shown in four parts designated FIGS. 8A to D respectively.
Figure 8B:
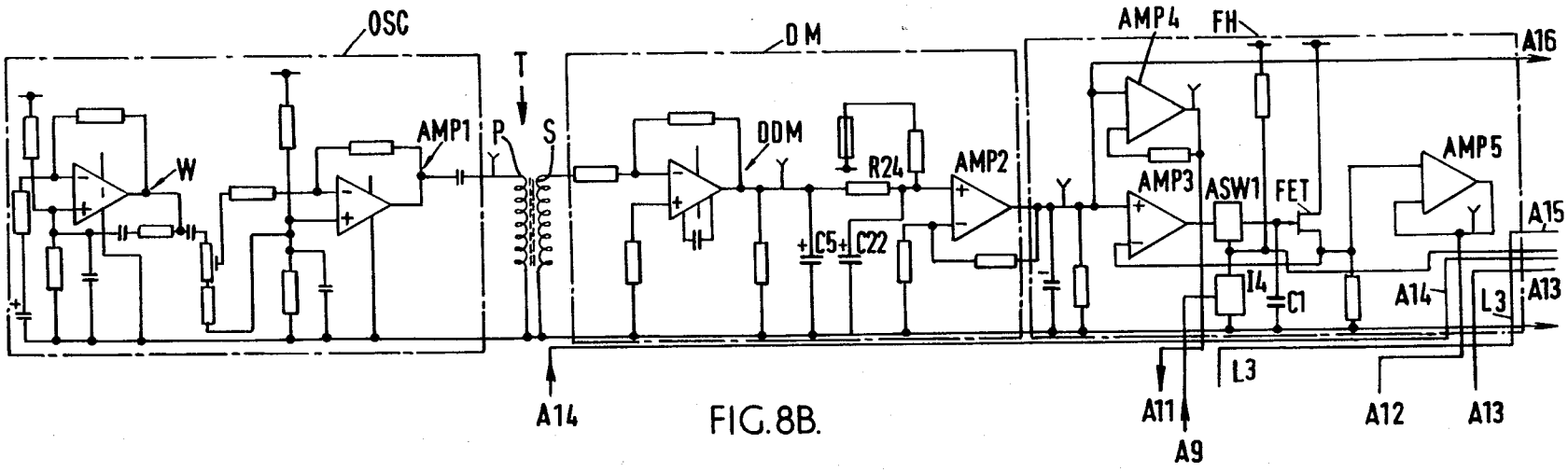
Figure 8C:
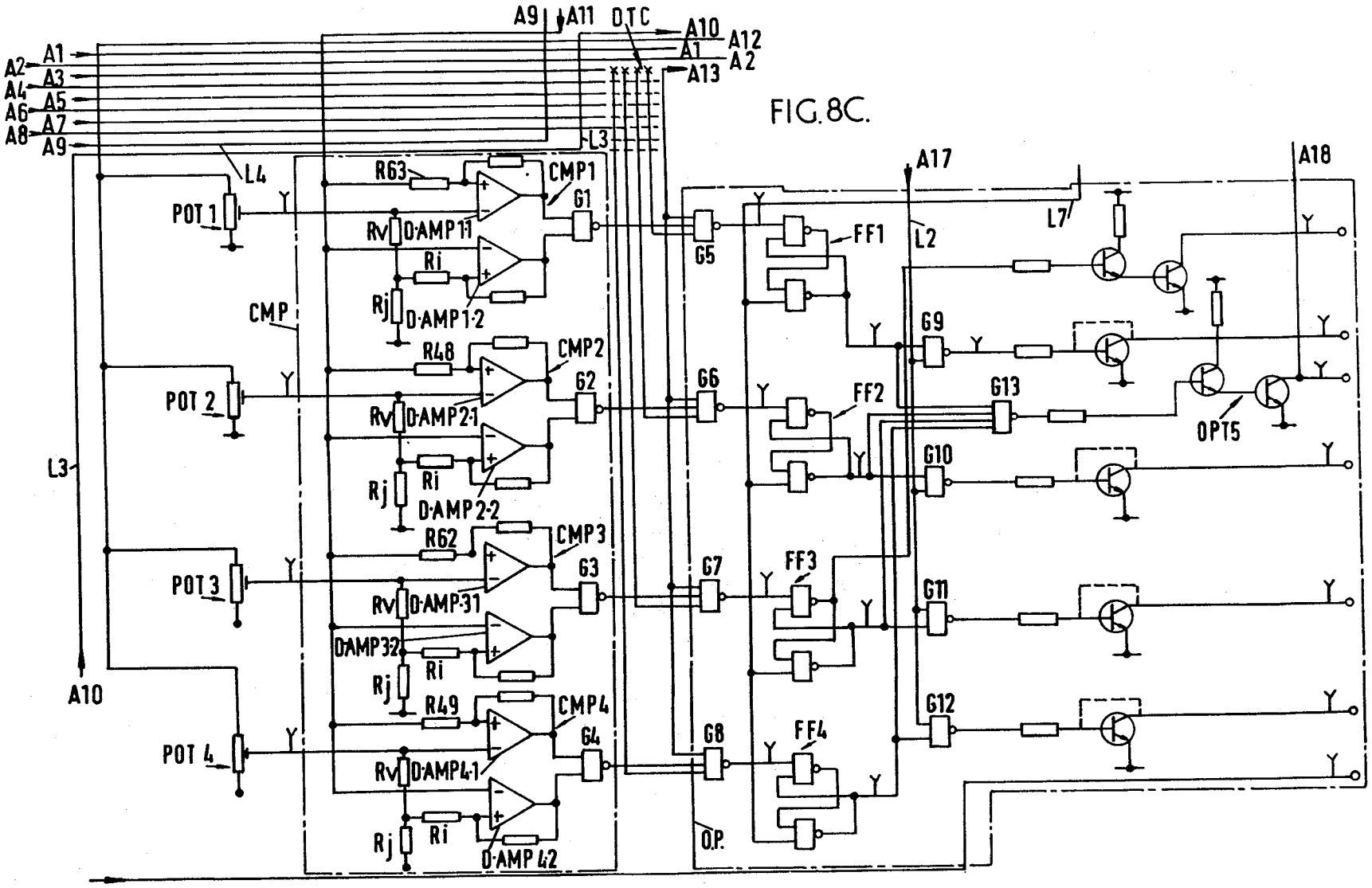
Figure 8D:
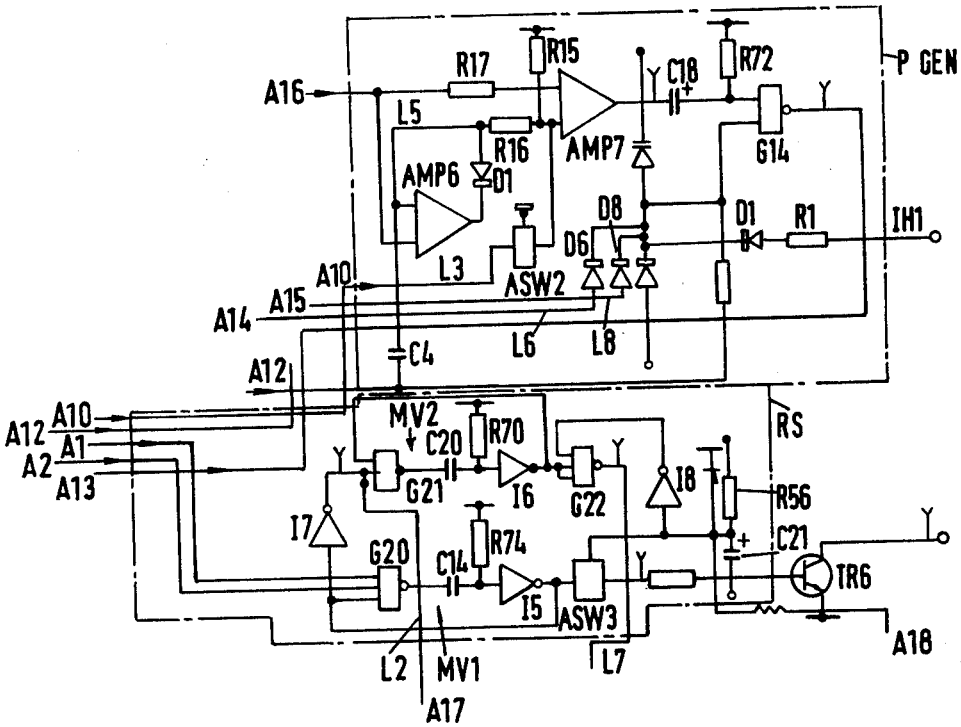

The front plate 6 has secured thereto two spacers 12, 13 (FIG. 5) which, together with the front plate 6 and the rear plate 7, form the coin chute; the spacers maintaining a minimum separation between the front and rear plates and providing inner edge faces 12.1, 13.1 respectively, which act to define the pathway of a coin through the chute. In the pathway of the coin, the front plate 6 and the rear plate 7 each has a cut-out portion in which is positioned a tray, 14, 15 respectively, secured in position by self-tapping screws Sc passing through bores in the respective plate and into bores provided in flanges 14.1, 14.2 and 15.1, 15.2, integral with the respective tray. The tray 14 is usually covered by a plate 16 and carries a former F1 (FIG. 2), on which is wound the primary coil P of a transformer T and a mounting board MB1 for three light emitting diodes, LED 1, 2 and 3 respectively. The tray 15 carries a former F2 (FIG. 3) on which is mounted the secondary coil S of transformer T, and a mounting board MB2 for three photo-cells, Ph1, 2 and 3 respectively, the lamps for which are constituted by diodes LED1, 2 and 3 respectively. The transformer is shown in FIG. 8B. The tray 15 is formed with an upstanding flange 17 (FIG. 3) to which is secured a bracket 18, mounting a solenoid Sd1, by two screws Sc1 passing through bores in the flange and into tapped bores in the bracket 17. The armature 20 of solenoid Sd1 passes through a bore 19 in the floor 15.3 of tray 15 and carries at the end passing through the bore, a stop bar 21 which, when the solenoid is a de-activated, lies in the coin chute. The floor 15.3 of the tray 15 also provides a bore, Sb1.1, 2.1 and 3.1 respectively, at the place of each photocell Ph1, 2 and 3; and similarly the floor 14.3 of the tray 14 provides a bore, Sb1.2, 2.2 and 3.2 respectively, at the place of each diode LED1, 2 and 3 so that the respective diode and photocell may act as a photo sensor in response to a coin passed down the coin chute. It may be noted that the sensor constituted by diode LED1 and photocell Ph1 is located just upstream in the direction of coin travel of the stop bar 21, and that the other two sensors, i.e. those constituted by diode LED2 and photocell Ph2, and diode LED3 and photocell Ph3 respectively, are located spaced apart across the line of travel of the coin in the chute as it rolls along the edge surface 13.1 of spacer 13: the spacing is such that the smallest coin fails to interrupt the light beam of either of the sensors, the next larger coin interrupts the light beam of the one of the two sensors nearest the edge surface 13.1 and the largest coin interrupts the light beams of both of the sensors. The above described arrangement is, therefore, intended to deal with three coin sizes. More sensors may be used if a greater number of coin sizes are to be dealt with. The above-described arrangement is merely exemplary and the sensors could be arranged so that the smallest coin breaks the light beam of one of them i.e. the one nearest the edge surface 13.1. With two sensors, this would mean that only two coin sizes could be tested for; and generally, in this alternative arrangement, the same number of sensors will need to be employed as the number of coin sizes to be tested for.

The rear plate 7 carries on its front surface (FIG. 6) a spring metal bar 22; the bar being formed with an integral flange 22.1 rivetted or otherwise fastened to the rear plate 7. The bar is raised from the level of the flange so as to lie spaced from the front surface of the rear plate by the width of the coin chute (as determined by spacers 12 and 13) and normally lies within a recess 23 formed in the floor 14.3 of tray 14. The purpose of this bar will be described hereinbelow.

The rear plate 7 also carries a coin hopper Ch.H to guide coins into the coin chute, the hopper consisting of a front part 24.1 providing the front wall 24.11 of the hopper and comprising a depending flange 24.12 screwed to the front surface of the front wall by screws Scg passing through the flange and received in tapped bores in the front wall, and a rear part 24.2 providing the lateral walls 24.21 and 24.22 and the rear wall 24.23 of the hopper and comprising a depending flange 24.24 screwed to the rear surface of the rear plate 7 by screws Scg.2 passing through the flange and received in tapped bores in the rear plate. The flange 24.24 bears an integral arm 24.25 to which is bolted a bracket 25, mounting a solenoid Sd2, by screws 26, 27. The armature 20 of the solenoid faces a bore 29 and when extended, on activation of the solenoid, projects into and across the coin chute to bar the passage of any coin or, if a coin is already positioned facing the bore 29, to pin the coin against the front plate 6. The solenoid Sd2 is orientated in the opposite sense to solenoid Sd1 and thus works in anti-phase therewith.

Figure 2:
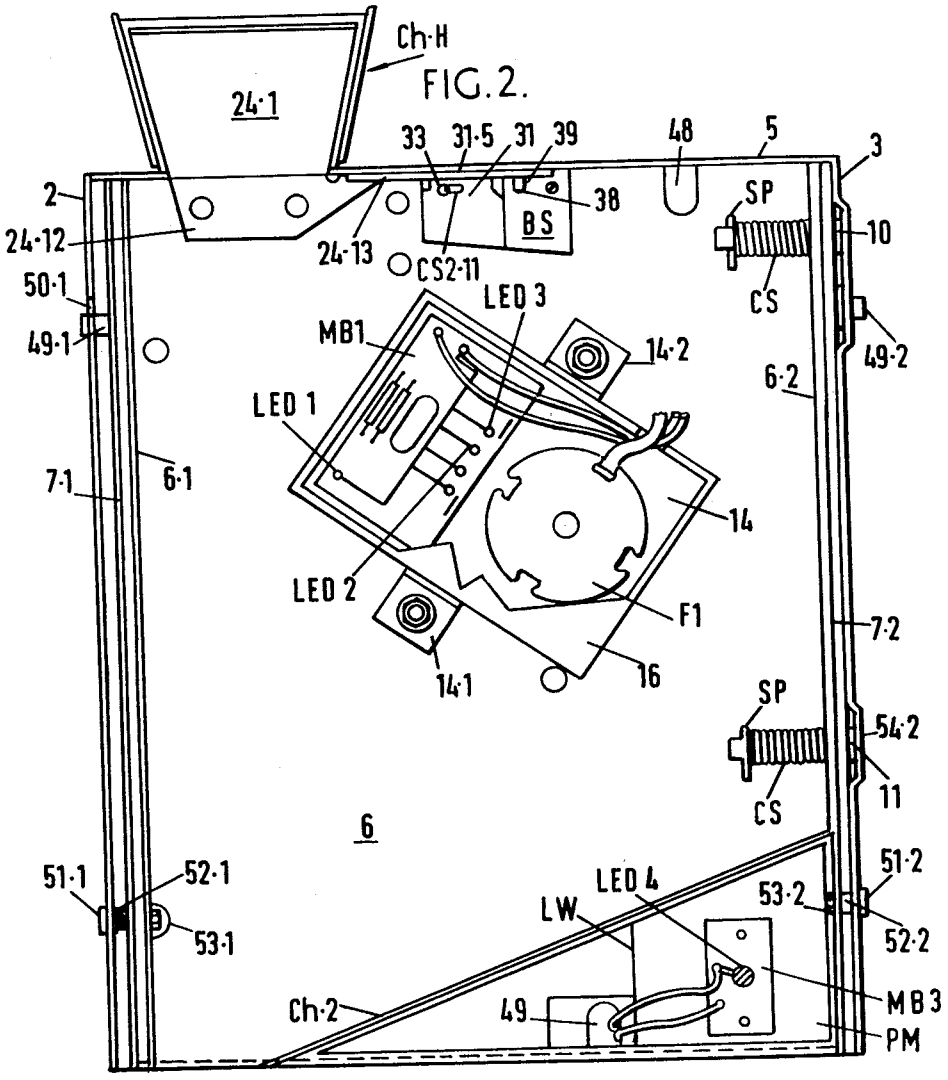
FIG. 2 is a front elevation of the device of FIG. 1.
Figure 3:
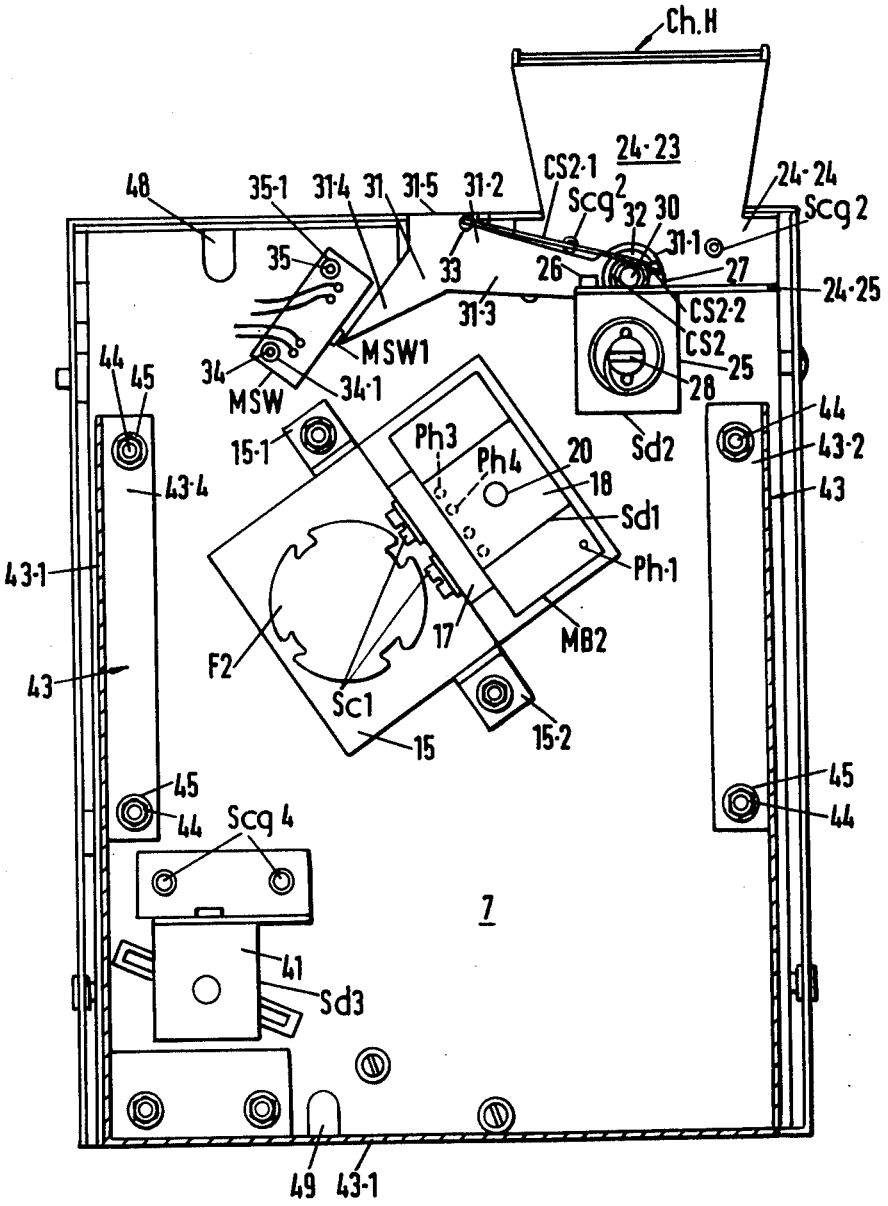
FIG. 3 is a section on the line X—X of FIG. 1.
Figure 6:
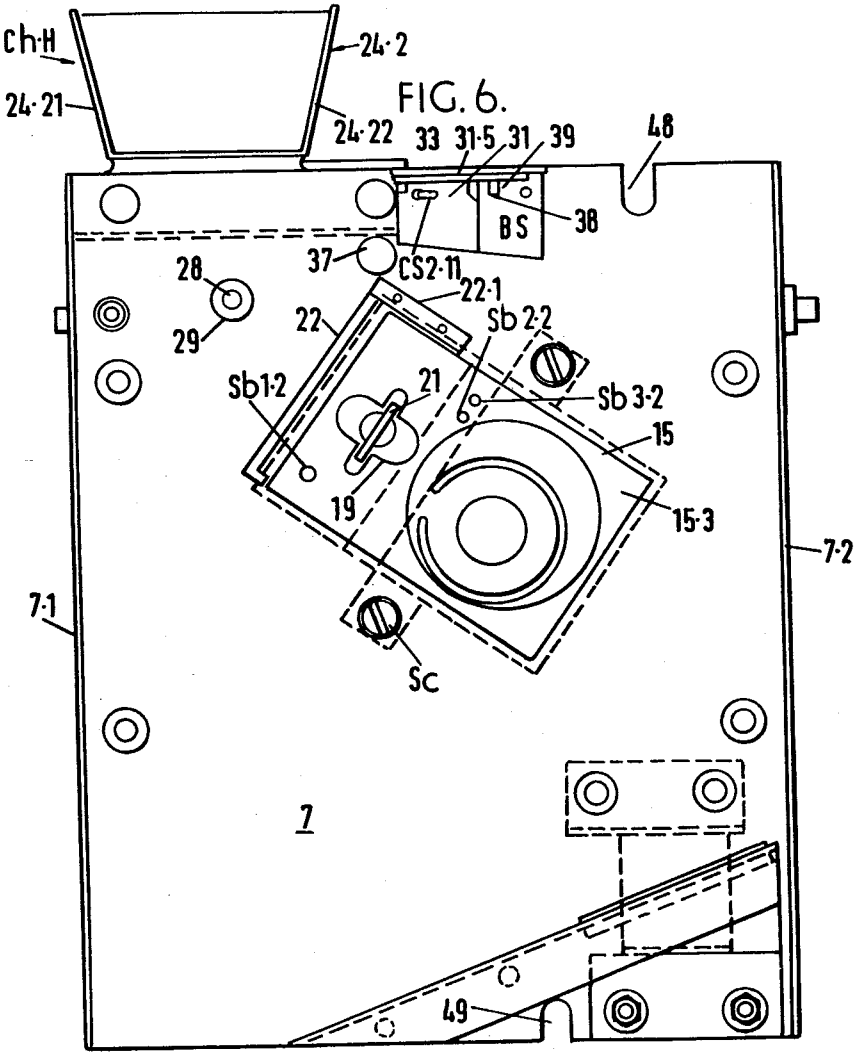
FIG. 6 is a front elevation of a rear plate of the device of FIG. 1.

The depending flange 24.24 has a pin 30 fixed therein; and a lever 31 is mounted on the pin so as to be able to pivot therearound. The lever comprises a boss 31.1, by which the lever is mounted on the pin 30, an arm 31.2, providing an angled surface 31.3, a finger 31.4, extending from the arm, and a press plate 31.5 by which the lever can be depressed from its rest position as shown in FIGS. 2, 3 and 6, with the thumb or finger. The pin also carries a collar 32, made integral with the pin to hold the lever on the pin, and the coil of a coiled spring CS2 bearing two arms CS2.1 and CS2.2. The rm CS2.1 has a portion at the free end thereof formed with a step CS2.11 in it which passes through a hole 33 in the lever and thereby attaches the arm to the lever. The other arm CS2.2 extends under the arm 24.25 of coin hopper 24 and abuts against the adjacent edge of the arm 24.25 to stop the spring from turning on the pin 30 when the lever is depressed. The spring thus resiliently biasses the lever to its rest position. The front plate 6 bears on its rear surface (FIG. 5) a pin 36 which projects through a facing bore 37 in the rear plate 7 to abut at its free end against the underside of the angled surface 31.3 of lever 31 so that when the lever is depressed from its rest position, the pin 36 is displaced by the angled surface to push the front plate 6 away from the rear plate 7 and cause the front plate to turn on the bolts 11, 12 as above described, thereby widening or "splitting" the coin chute. This mechanism is provided to permit a jammed coin to be released. A coin may jamm in the coin chute if it is inserted when a previously inserted coin is still held by the stop bar 21. On splitting of the coin chute by depression of lever 31, the further coin is released simply to fall through the coin chute and be returned to the user. The previously inserted coin, however, is held in position on the stop bar 21, by the spring metal bar 22 as the front plate hinges away from the rear plate. Accordingly, only the jammed coin needs to be recovered and re-inserted in the coin chute. When lever 31 is in its rest position, the press plate 31.5 thereof acts as a stop for an abutment member 24.13 formed integrally with the depending flange 24.12 of the front part of the hopper, and thereby prevents the chute from being split under the force of coins inserted therein. To prevent operation of the validator circuit during splitting of the coin chute, a microswitch MSW is mounted on the rear plate 7 for operation by the finger 31.4 of lever 31. The switch is mounted on the rear face of the plate by bolts 34, 35 and nuts 34.1, 35.1 in a position such that the switch operating member MSW.1, biassed to the "on" condition, is held in the "off" condition by the finger 31.4 of lever 31 when the lever is in its rest position, but is permitted to move to the "on" position under the bias when the lever 31 is depressed and removes the finger from contact with operating member. When the switch is in the "on" condition, it connects a voltage source to an inhibit input of the validator circuit to prevent operation thereof as will be more fully described hereinbelow. The lever also bears a depending lug 38 (FIG. 2) supporting a thrust member 39 to take the thrust of the lever 31 when the lever is depressed. For this purpose, the cut-out portion of the front plate is somewhat wider than that of the rear plate so that a portion BS of the front face of the rear plate lies exposed to the thrust member, and the thrust member bears on that portion of the rear plate when the lever is depressed. The lever 31, when released from its depressed position, returns automatically to its rest portion under the bias applied by spring CS2 and, as the lever returns to its rest position, the front plate also returns automatically to its closed position, that is, the position in which spacer plates 12 and 13 abut against the rear plate 7, under the bias applied to the front plate 6 by coil springs CS as above described.

The coin chute Ch downstream of the coin-denomination detector, divides into a channel Ch1 for accepted coins and a channel Ch.2 for rejected coins; the former channel being guarded by a coin gate, generally indicated at CG. The coin gate opens only in response to a signal from the validator circuit indicating that the coin falling down to the gate is a valid coin and, when closed, causes coins automatically to be directed along the reject channel Ch.1 for return to the user.

The coin gate comprises a stop member 40 secured to the armature of a solenoid Sd.3. The solenoid is mounted in a bracket 41 secured by screws Scg.3, received in tapped bores in the bracket 41, to the upstanding flange 42.1 of an angle piece 42 the other flange 42.2 of which is secured to the rear plate 7 by screws Scg.4 passing through the flange and received in tapped bores in the rear plate 7. The solenoid Scd 3 is activated only by a signal from the validator circuit indicating a valid coin and, on activation, withdraws the stop member 40 from the coin chute so that the coin concerned falls through the gate into channel Ch.1. Otherwise, the solenoid is de-activated and and positions the stop member 40 in the chute to direct coins into channel Ch.2. To ensure that a coin in response to which the gate is opened has actually passed through through the gate and into the channel Ch.1, a photosensor is stationed just downstream of the gate in channel Ch.1. A plastics moulding PM serves to mount a mounting board MB3 for a light emitting diode LED4 constituting the lamp of the sensor. The front 6 is cut away obliquely at the lower right hand corner as viewed in FIG. 6, to permit the plastics moulding to be mounted against the rear plate 7 in the area of the cut away portion of the front plate. As viewed in front elevation, the moulding is triangular shaped with the side representing the hypotenuse of the triangle forming on its upper surface, a lower guide surface for reject chanel Ch.2. The moulding bears a recess RC of a general U-shaped section so that the lateral walls LW of the recess and the web of the "U" form three walls of the accept channel Ch.1, the fourth wall of which is formed by the front face of rear plate 7. The moulding is provided with a bore (not shown) to permit the light beam of the diode LED4 to pass across the channel Ch.1, and a facing bore (not shown) is provided in the rear plate 7. The rear plate has mounted thereon a mounting board MB4 for a photocell Ph.4 so as to position the photocell to receive light from the diode LED4 through the bore in the rear plate. Thus, a coin which passes into the channel Ch.1 necessarily breaks the light beam of diode LED 4 to cause the photocell to produce a signal indicating the fact. The purpose of this signal will be made evident below.

The rear plate 7 also has mounted thereon a sub-chassis 43 (FIG. 3) comprising a bottom wall 43.1 and two lateral walls 43.2 and 43.3 bearing inturned flanges 43.4 and 43.5 by which the sub-chassis is mounted on the rear plate 7 by bolts 44 passing through bores in the rear plate and the respective flanges and and held in place by nuts 45. The circuit of the validator, represented in FIG. 8 but not otherwise shown, is in the form of a printed circuit board and is supported on the sub-chassis by two ledges (not shown), one on the inner face of each lateral wall 43.2 and 43.3 each bearing a groove to receive a side edge of the printed circuit board. The lateral walls 43.2 and 43.3 are slightly flexible and can be prised apart to permit the circuit board side edges to be seated in the grooves respectively with the bottom edge of the circuit board resting on the bottom wall 43.1 of the sub-chassis. The printed circuit board is thus gripped from each side edge and supported at its bottom edge by the wall 43.1. The sub-chassis also carries a socket 43 (FIG. 7) for external electrical connection to the circuit, the socket being exposed to the exterior of the device through a cut out (not shown) in the lateral wall 43.2 and a cut out 47 in the casing 1, and an internal connection board (not shown) through which connections between the circuit, the coin detector, coin sensors and solenoids and the socket 46 are made.

In the above description electrical leads have not been identified since the need for them and the provision of them are self-evident to a skilled person. However, to permit leads from the front side of the coin chute to be conveniently taken over to the other side to the internal connection board, the front and rear plates and the plastics moulding PM are formed with matching cut-out portions. Thus, a cut out 48 is formed at the top of the two plates through which leads from the primary coil P and the diodes LED1, 2 and 3 are passed over to the internal connection board; and, similarly, a further cut out 49 is formed at the bottom of the rear plate and in the plastics moulding to permit leads from the diode LED4 to be passed through to the internal connection board.

Figure 7:
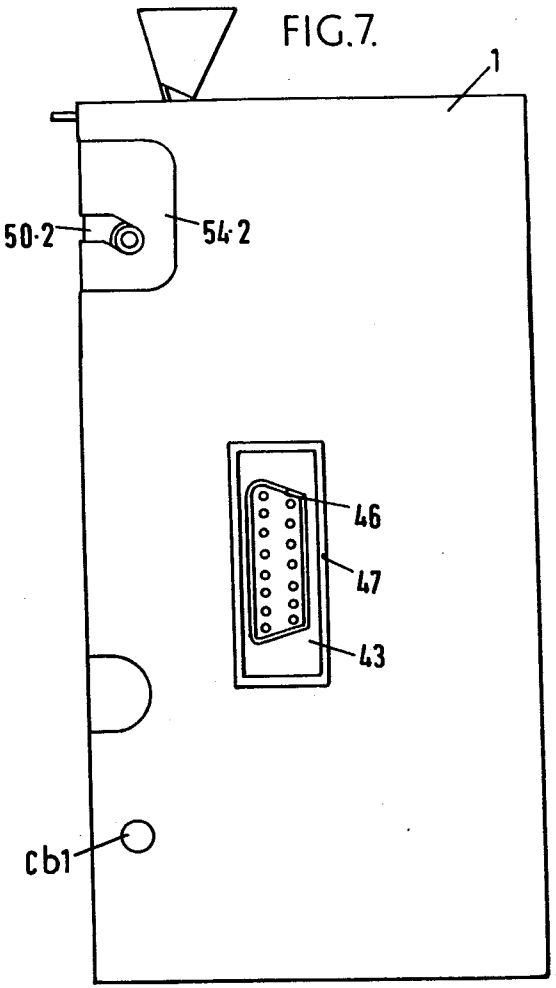
FIG. 7 is a side view of the device of FIG. 1.

The assembly of the front and rear plates, the sub-chassis and circuit, is hinged in the casing 1 by two pins 49.1 and 49.2 secured in the lateral walls 7.1 and 7.2 respectively of the rear plate 7 to extend outwardly therefrom, which are received in angled slots 50.1 and 50.2 formed in the respective sidewalls 2 and 3 of the casing 1 (see particularly FIG. 7) and is secured in place in the casing at each side thereof by bolts 51.1 and 51.2 respectively. The bolts pass through respective bores, one of which Cb1 is shown in FIG. 7, in the respective casing side walls, tapped sockets, 52.1 and 52.2 respectively, held in respective bores in the lateral walls 7.1 7.2 of the rear plate, and a cut out 53.1 in lateral wall 6.1 of the front plate, in the case of bolt 51.1, and a cut out 43.2 in the plastics moulding PM, in the case of bolt 51.2, the bolts being secured in place by respective nuts 53.1, 58.2.

The validator is thus made up into a self-contained unit although it will be understood that other modes of assembly and casing could be used for this purpose.

When a coin is inserted in the coin chute Ch of the above described embodiment, the coin in falling down the chute first breaks the light beam of diode LED1 to case photocell Ph1 to produce a signal. The coin is then stopped by the stop bar 21 on which for a brief interval it will bounce before coming to rest. The signal produced by the photocell Ph1 is received by the circuit of the embodiment which, in response thereto, produces a solenoid signal but only after a delay calculated to be sufficient to allow the coin time to come to rest. The solenoid signal is applied to both of solenoids Sd.1 and Sd.2 to cause solenoid Sd.1 to withdraw the stop bar 21 from the coin chute and simultaneously cause solenoid Sd.2 to extend the armature thereof into the coin chute thus to bar any further coin then inserted or if, at this instant, the further coin has already been inserted, to pin the further coin against the front plate 6. On withdrawal of stop bar 21 the coin supported thereby falls past first the station of the diodes LED2 and 3 and photocells Ph.2 and 3, if used, and then the primary and secondary coils of transformer T to produce a coin signal the amplitude of which depends, generally, on the demonination of the coin. The circuit then receives any signal from photocells Ph.2 and 3, if used, and the transformer signal to test the coin for validity as the coin is still falling down the coin chute between the transformer coils and the coin gate CG. The test is completed before the coin reaches the gate and, if the test indicates a valid coin, the gate opens to admit the coin into channel Ch.1 of the coin chute and then closes again. The coin will then break the light beam of diode LED4 and cause photocell Ph.4 to produce a signal. In response to this signal the circuit produces an output signal to operate the mechanism, for instance, a turnstile or vending machine, the validator is used with. If no signal is produced indicating a valid coin, the gate CG remains closed and the coin is directed into the reject channel Ch.2. The reject channel will usually give access to some receptacle from which the user may recover the coin while the coin-accept channel Ch.1 may give access to a coin vault or to an escrow facility.

If, in use of the validator, coins become jammed in the coin chute, splitting of the channel as above described releases the jammed coins which fall down to the gate CG and then along the reject channel Ch.2.

The circuit of the present embodiment provides for the testing of up to four coin denomination and a token as an alternative to one of the coin denominations. The denominations may be regarded as being the 2*p*, 5*p*, 10*p* and 50*p* denominations of British currency. From the transient disturbance produced in the operation of transformer T by a coin falling between the coils thereof, the circuit generates a symmetrical voltage signal VS (FIG. 9) which may be regarded as comprising a voltage through representing the peak amplitude of the signal. It will be understood, however, that the circuit could be arranged so that the voltage signal VS could be regarded as comprising a voltage peak. The effect of the coin on the transformers operation varies, for any given transformer, with the size and composition of the coin, with the result that coins of the different denominations mentioned above give rise to signals of different amplitude. In connection with the coins mentioned of the British currency, it may be assumed that the amplitude of the signal VS increases with the value of the coin, but again it will be understood that the circuit could be arranged so that the amplitude of the signal decreases with an increase in the value of the coin demonination.

The circuit (FIG. 8) generally comprises the transformer T and, is indicated by the boxes shown in broken line, an oscillator circuit OSC the output of which is fed to the primary P of the transformer T, a circuit DM for demodulating the oscillation induced in the secondary coils of the transformer, to produce, in the no signal condition of the transformer, a steady voltage from which reference voltages are derived representing that condition, a comparator stage CMP consisting of a set of four "window" type comparators CMP 1, 2, 3 and 4 respectively in which demodulated voltages are compared, there being one comparator for each coin denomination to be validated, timing circuits TC, a follow and hold circuit FH, a peak generator P.GEN for generating a control signal at the peak of the coin signal, that is, the signal induced in the transformer secondary S by the coin, a diameter test signal circuit DTC, reset circuit RS and output logic and signal stages OP.

The circuit of the embodiment operates, when a coin is detected by the transformer T, to compare the signal produced with different amplitude parameters set up electrically in the comparators; the four parameters concerned corresponding to the signal amplitudes produced by coins of the different denominations. If the amplitude parameter of any of the comparators is equal to or less than that of any signal produced, the comparator is operated less than that of any signal produced, the comparator is operated to produce an output signal. However, each comparator operates only by a switching action from an "Off" condition to an "On" condition and then back to the "off" condition to produce a discrete output signal. Thus, although more than one comparator may be operated by a signal derived from sensing a coin, because of the nature of the signal causing such operation, the comparators concerned would produce their output signals at different times, viz: the greater the amplitude of the coin sensing signal, the earlier in time before the peak of any signal, will any comparator, set up for a lesser amplitude of signal, operate. On sensing a coin, the peak generator also generates, to coincide with the peak of the coin signal, a control signal by which only the comparator output signal produced simultaneously with the control signal is taken as indicating a valid coin. It will be seen, therefore, that only the output signal of the comparator which is itself operated by the peak of the signal derived from sensing a coin, is taken as indicating that the coin sensed is one of a valid denomination. Since coins used in a coin slot machine may be worn or damaged and thus give rise to some variation in the signal derived from sensing the coins, each comparator is arranged so that it is switched between two slightly different voltage levels; the levels being chosen, by prior trial and error, to provide maximum validation of valid coins and maximum rejection of invalid coins. If the photosensors are used to test coin diameter, the circuit DTC produces a signal which is applied to the output logic to prevent any output signal being produced if the coin diameter indicated is not the one whose validity is otherwise indicated by the circuit, i.e. by the comparator and the control signal coincidence. The diameter test may be provided in those instances where due to the particular combination of size of coin and choice of material thereof, coins of diffetent denominations fortuitously give rise to substantially the same amplitude of signal in transformer T.

The signal provided by the sensor stationed downstream of the coin gate CG, is also applied to the output logic to gate the signal indicating a valid coin. The purpose of this is to prevent valid coins being retrieved from the coin chute after an output signal has been taken from the circuit, i.e. to operate the machine the validator is used with. Otherwise, the machine could be operated repeatedly with the same coin by retrieval of it each time from the coin chute, for instance, by attaching it to a length of thread or string.

To permit the comparators to operate between a lower and a higher level of signal amplitude, each comparator comprises a pair of differential amplifiers with one of them set to switch on when any signal applied to it exceeds the lower limit and with the other of them set to switch off if the applied signal amplitude exceeds the higher limit. The output stage of each comparator comprises an AND gate so that as the one amplifier switches on one of the input signals is applied to the gate by the amplifier. Since the other amplifier is "on", the other input to the gate is already present and thus the comparator produces an output. If the peak of the signal occurs between the limits set by the comparator, then following operation of the one amplifier, the signal will decay and switch that amplifier back to the "off" condition, thus removing one of the inputs to the AND gate. If, however, the peak of the signal lies beyond the upper limit of the comparator, the other of the amplifiers will be switched to the "off" condition and agin remove one of the inputs from the AND gate. In either instance, therefore, the comparator ceases to produce an output at substantially the same instant in time.

Figure 9:
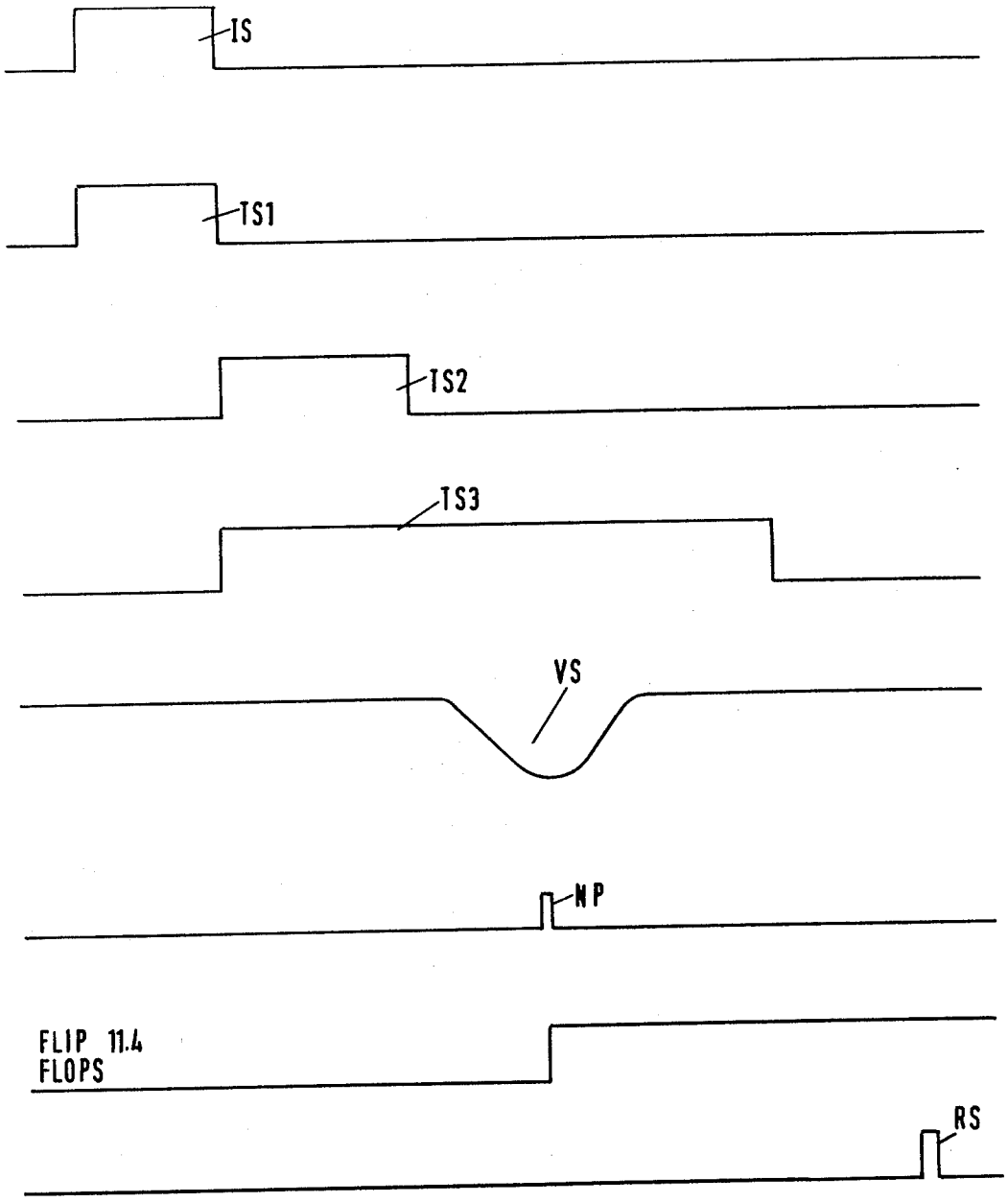
FIG. 9 is a timing diagram of signals employed in the circuit of FIG. 8.

The signal produced by photocell Ph.1 is used to initiate operation of the timing circuits TC which constitute monostable devices producing signals, TSI, TS2 and TS3 respectively, shown in FIG. 9 on the same time base as the signal IS from the photocell Ph.1. It may be noted from FIG. 9 that the signals TS2 and TS3 are produced only on the trailing edge of signal TCl. Signal TSI is a delay signal during the period of which the coin comes to rest on the stop member 21, signal TS2 (which may be called the blocker signal) is used to operate solenoids Sd.1 and Sd.2 and signal TS3 is used to determine the period during which a coin signal is tested. Each of the signals is also used for an additional purpose; and the employment of these signals will be more fully described hereinbelow.

The signal IS is applied through resistor R10 to the base of a common emitter transistor amplifier TR10 to develop a positive going signal voltage across output resistor R11 which is applied to input pin 1 of a NOR gate G15 to produce a negative going output signal therefrom the constitute the input signal to the timing circuits. The latter consist of three monostable devices TC1, 2 and 3 respectively, each comprising a timing capacitor C15, 16 and 17 respectively, charged through a resistor T75, 76 and 77 respectively, from a positive voltage source VDD. Circuit TC1 further comprises an input NOR gate G16, and an output NOR gate G17. An input pin 12 of the gate G16 is connected to the output of gate G15 while the output of the gate G16 is connected to the negative terminal of capacitor C17. An input pin 2 of the gate G16 is connected to the positive terminal of capacitor C17 and the output of the gate is connected to the input pin 12 of NOR gate G15 and to the input of inverting amplifier I1. A second input pin, pin I, of gate G 16 is connected to a signal input line LI from an inhibit input which will be more fully described hereinbelow. Circuit TC2 additionally comprises an input NOR gate G18 the output of which is connected to the negative terminal of capacitor C15, and an inverting amplifier I2 the input of which is connected to the positive terminal of capacitor C15. An input pin 5 of NOR gate G18 is connected to the output of amplifier I1 while a second input pin, pin 6, of the gate is connected to the output of amplifier I2. The circuit TC3 is similarly constituted and additionally comprises input NOR gate G19 and inverting amplifier I3 with input pin 6 of the gate connected to the output of amplifier I2 of circuit TC2 and with input pin 5 of the gate connected to the output of amplifier I3. The amplifiers I2 and I3 switch to produce an output signal, that is, a positive signal, only when the input thereto rises in the positive direction and accordingly do not produce an output signal until the trailing edge of signal TSI is applied to input gate G18 of circuit TC2, due to the effect of inverting amplifier I1.

The oscillator circuit comprises a Weinbridge type oscillator W feeding through a buffer amplifier AMP1 to the primary of a transformer T. The oscillations in the secondary coil S of the transformer are demodulated in the circuit DM which comprises a halfwave demodulator DDM producing a positive output voltage, a filter network comprising resistor R24 and capacitors C5 and C22, for filtering the demodulated voltage for ripple, and an amplifier AMP2 for amplifying the filtered voltage; the output of the amplifier being fed to the follow and hold circuit FH.

The follow and hold circuit comprises an input amplifier AMP3, receiving at its positive input pin the output voltage of amplifier AMP2, and a voltage follower comprising amplifier AMP4 providing a first reference voltage at the output thereof. The output voltage of the amplifier AMP3 is applied through an analogue switch ASW1 to a capacitor C1 the charge on which controls the conduction of a field effect transistor FET. The potential developed at the source electrode of the transistor FET is applied to a further voltage follower comprising amplifier AMP5, which provides a second reference voltage at the output thereof. The effect of amplifier AMP3 is to overcome the voltage offset between the gate and source electrodes of transistor FET so as to ensure that the voltage applied to amplifier AMP5 has the same value as the demodulated input voltage to amplifier AMP3. The switch ASW1 is normally on and is supplied with an operating voltage through inverter I4 and line L4 from the output of timing circuit TC3, the signal TS3 from which opens the switch to isolate the capacitor C1 from amplifier AMP3.

The comparators CMP 1, 2, 3, and 4 comprise pairs of differential amplifiers, D.AMP1.1 and 1.2, D.AMP2.1 and 2.2, D.AMP3.1 and 3.2 and D.AMP4.1 and 4.2 respectively. Amplifiers D.AMP1.1, 2.1., 3.1. and 4.1 receive respectively at their positive and negative input pins, the first reference voltage through resistors R63, R48, R62 and R49 respectively, and the second reference voltage through potentiometers POT1, 2, 3 and 4 respectively, whilst amplifiers D.AMP.1.2, 2.2, 3.2 and 4.2 receive respectively at their negative and positive input pins, the first reference voltage directly and through a respective resistor Rv of a voltage divided comprising resistor Rv and resistor Rj, and a further resistor Ri, the second reference voltage. For any given setting of the respective potentiometers, POT 1 to 4, resistor Rv determines the range of amplitude between the limits at which the comparator will operate while resistor Rj of the voltage divider determines the voltage level of the lower one of the limits.

Each comparator comprises an output NOR gate, G1, 2, 3 and 4 respectively, serving an AND function, receiving an input from each comparator and providing an output to the output logic and signal circuit OP. The latter circuit comprises NAND gates G5, 6, 7 and 8 one of the inputs of each of which is connected to the output of a respective one of gates G1 to 4, and a second of the inputs of each of which is connected to the peak generator P.GEN as hereinafter described; and each NAND gate controls a flip flop, FF1 to 4 respectively, the reset output of which is connected to one of the inputs of a 2-NAND gate, G9, 10, 11 and 12 respectively. The 2-NAND gates serve as the circuit output devices from which, when actuated, an output signal representing one of the coin denominations is taken for use in operating the machine the validator is used with. The other input of each 2-NAND gate G9 to 12, is taken from the reset circuit RS which operates in response to a signal from photocell Ph4 to provide the second input to the gate. It will be apparent from this that no output signal from the circuit is produced until the signal from photocell Ph 4 is provided. The output signal from each NAND gate may be used directly as the circuit output signal or it may be used to operate a transistor output stage, OPT1 to 4 respectively to provide the circuit output signal. In the former case, the transistor stages are shorted out as indicated by the link shown in broken line between the base and collectors of the respective transistors. The reset output of each of the flip-flops is also connected to a 4-NOR gate G13 which, on operation of the gate by an output from any of the flip-flops, provides a signal through transistor stage OPT5 to pulse solenoid Sd3 and open the coin gate.

The peak generator comprises an operational amplifier AMP6 the negative input of which is connected to the positive terminal of a capacitor C4 the other terminal of which is connected to the zero voltage line. The positive input of the amplifier is connected to the output of the demodulator circuit, and the output of the amplifier is connected through diode D1 and feedback line L5 to the negative input of the amplifier; the feedback line being connected through resistor R16 to the negative input of a further operational amplifier AMP7. The junction between resistor R16 and the negative input is connected to voltage source VDD through a large resistor R15 and also to the voltage source through an analogus switch ASW2 the signal input to which is connected to the output of timing circuit TC1 through line L3. The positive input of amplifier AMP6 is also connected, through resistor R17, to the output of the demodulator circuit, and the output of amplifier AMP6 is connected to a differentiator comprising capacitor C18 and resistor R72, and an output NOR gate G14 the output from which is connected to the respective input of each of NAND gates G5 to 8.

When the signal (Vs FIG. 9) is produced by the secondary of transformer 7, the signal is imposed on the steady voltage from the demodulator circuit and drives the voltage at the respective input of amplifier AMP5 negative, causing the amplifier to discharge the capacitor C4 to follow down the signal voltage. When the signal reaches its peak amplitude, however, and begins to go positive, the capacitor cannot charge at the same rate as the signal falls since due to diode D1 the amplifier AMP6 now permits the charging of the capacitor only through the large resistor R15. As a result, the voltages on amplifier AMP6 cross over and the amplifier switches to produce a high level signal which is differentiated by the differentiator to produce at the output of gate G14 a narrow pulse (NP FIG. 9) occurring substantially at the peak of the signal. Thus, if any comparator is operated by the peak of the signal, the respective one of NAND gates G5 to 8 is enabled to switch the respective flip-flop. The switch A.SW2 is normally open but is closed by pulse TS1 from circuit TC1 quickly to charge capacitor C4 (if not already charged) directly from voltage source VDD. Because of the slow charging rate of capacitor C4 through resistor R15, there is a possibility that the capacitor would not have fully charged from a previous operation before the peak generator is required to operate again due to the insertion of a further coin in the chute rapidly following on the previous coin. The provision for charging the capacitor through switch A.SW2 ensures that the capacitor is always fully charged before the peak generator receives a coin signal.

The output gate G14 is inhibited by the voltage provided from inverter I4 in the follow and hold circuit FH through diode D8 and line L8, when the switch A.SW1 is in the on condition i.e. in the quiescent condition of the circuit. When the output of the inverter is switched by signal TS3 from circuit TC3, the inhibiting voltage on the gate is removed from this source, but the blocker signal TS2 is also applied to the gate through diode D6 and line L6 to maintain the inhibition for the period of that signal.

The reset circuit comprises two monostable devices MV1, MV2, in series and each comprising a capacitor C14, C20 respectively, charged through a resistor R74, R70 respectively, an input 3-NOR gate, C20 and C21 respectively, and an output, inverting amplifier I5 and I6 respectively. The output of amplifier I5 is fed back to one of the inputs of gate G20 and through an inverting amplifier I7 to two, commoned, inputs of gate G21 and then through line L2 to the respective inputs of 2-NAND gates G9 to 12. A second input of gate G20 is connected to the photocell Ph4 to receive any signal therefrom and the third input may be commoned to the second one or connected to a photosensor for sensing validated tokens. The third input of gate G21 is received from the output of amplifier I6.

The monostable MV1 fires in response to a signal from photocell Ph4 to provide the gating pulse to 2-NAND gates G9 to 12 as above mentioned. The pulse is also applied to circuit MV2 which fires on the trailing edge of the gating pulse, itself to provide a pulse which is gated by a NOR gate G22 through line L7 to reset the flip-flops FF1 to 4. The NOR gate G22 has a second input commoned to the first, and a third input on which a no-signal voltage is maintained by the charge on capacitor C21 applied through inverting amplifier I8. The capacitor charges through resistor R56, when power is switched on, and also applies a voltage to an analogue switch A.SW3 to keep it normally in the on condition. The gating pulse from circuit MV1 is also applied through switch ASW3 and resistor R4 to transistor TR6 to provide a strobe pulse which may be used for counting purposes.

In operation of the circuit on inserting of a coin, the signal TS1 is applied through line L3 to the analogue switch ASW2 to complete charging of capacitor C4 if not already complete, and on the trailing edge of signal TS1, nmonostables TC2 and TC3 fire to produce signals TS2 and TS3. The blocker signal TS2 is applied to the transistor amplifier stage comprising transistors TR13 and TR14 to provide a signal to operate solenoids Sd1 and Sd2, thus releasing the coin from stop bar 21 after the delay marked by signal TS1. The blocker signal is also applied, as mentioned above, to inhibit gate G14 of the peak generator; and since the blocker signal terminates just before the coin signal is produced, the inhibition provided by the blocker signal narrows the time period in which the peak generator can be operated to one closely coincident with the period of the coin signal, and thus reduces the possibility of operation of the peak generator by spurious signals induced in the transformer T. On the application of signal TS3 to switch ASW1 via line L4, the capacitor is isolated from the amplifier AMP3 but since the capacitor then has no discharge path, the charge on the capacitor is held to maintain the second reference voltage at the respective comparator inputs. Consequently, the coin signal, which is imposed on the steady positive voltage from the demodulator circuit, is transmitted only through voltage follower AMP4 while the second reference voltage is maintained steady. When the signal TS3 ends, the analogue switch ASW1 returns to the on condition, at which time the coin will have passed the transformer coils and the coin signal will have decayed to zero. The transformer may then receive a further coin although at this instant any flip-flop FF1 to 4 which has been operated at the peak of the coin signal will still be set and will not be reset until the signal from reset monostable MV1 is provided in response to the signal IS2 (FIG. 9) from photocell Ph 4.

It will be seen, therefore, that the circuit allows a definite time period for the testing of each coin even though successive coins may be inserted in the coin chute with a time interval less than the test period.

If a diameter test is to be employed, the outputs from a set of flip-flops, FF5, 6 and 7, respectively, are connected up to the third input of NAND gates G5 and 8 through the connection DTCC indicated in broken line, which may be strapped up to a circuit voltage if the diameter test is not needed.

Each flip-flop FF5 to 7 receives an input from photocells Ph such as photocells Ph2 and 3 described above, and an input from a line voltage VSS through resistor R78 through line L9 which is also connected to the output of circuit TC3, the output signal from which on termination thereof resets any flip-flop switched by a signal from the respective photocell. Which of the set and reset outputs of each flip-flop is connected to the respective NAND gate depends on the diameter to tbe tested for; the reset output being connected when the respective photocell is not required for the coin diameters which are to be tested for. If the connections DTC are strapped up to a circuit voltage i.e. when no diameter test is required, the voltage provided at the respective NAND gates is an enabling voltage.

The circuit is also provided with two external inhibit signal inputs IH1 and IH2. The input IH2 may receive an inhibit signal in case the device the validator is used with does not operate for some reason; the signal being applied through resistor R1 and diode D1 to inhibit the output gate G14 of the peak generator. The input IH2 may receive an inhibit signal from a coin escrow facility, provided when the facility is being emptied of coins, the signal turning transistor TR9 off and consequently latching gate G17 to a low level output. For validating the tokens used as an alternative to one of the coin denominations, a separate chute (not shown) is provided similarly constituted to the coin chute described above, the blocker signal for operating the solenoids corresponding to solenoids Sd1 and Sd2 being taken from the reset output of the one of flip-flop 1 to 4, in this instance FF3, of the respective coin denomination. Otherwise, the circuit operates in the same manner for the token validation as for the coin validation, with the monostable circuit MV1 receiving a signal from a photocell in the token channel corresponding to photocell Ph4 in the coin channel, producing the same effect as the signal from photocell Ph4.

The circuit also comprises an automatic reset taking a signal from the coin gate output OPTS, through resistor Rs to the input of amplifier 18 to provide an enabling signal on gate G22 to pulse the reset line L7. The effect of the signal from the coin gate output is to discharge capacitor C21 by an amount limited by diode DZ to provide a negative going signal which is inverted by amplifier 18 to produce a signal voltage level to the third input of NOR gate G22. This automatic reset is provided to ensure that the circuit is reset, for instance, should a validated coin for some reason not pass through the coin gate CG and instead pass out through the reject channel Ch.2. This prevents the solenoid Sd.3 from remaining activated and from burning out should there be a considerable delay before a further coin is inserted in the validator following the failure of the validated coin to pass through the coin gate.

We claim:

1. An electronic coin validator comprising:

a coin chute to guide the coin through the validator;

(a) a coin-denomination detector to sense a coin passing along said chute and provide a signal indicative of the denomination of the coin;

(b) a first stop member located substantially immediately upstream of the detector and normally positioned to block said chute while being movable to permit the stop member to be withdrawn therefrom;

(c) a first solenoid for operation of said stop member to withdraw it from and return it to said chute;

(d) a coin sensor located adjacent said stop member to sense the arrival of a coin thereat and provide a signal indicating the fact; and (e) an electronic validator circuit comprising means for responding to said sensor signal to provide a signal to operate said solenoid, after a delay sufficient to allow the coin to come to rest on the stop member, to withdraw said stop member from said chute and permit the coin to move past said detector, and then to return the stop member to the chute, and means to respond to said detector signal to determine therefrom whether the coin giving rise to the signal is one of a selected denomination;

said coin denomination detector comprising a transformer the primary winding of which is arranged at one side of said chute and the secondary winding of which is arranged at the opposite side of said chute, so that a coin in passing along the chute passes between the primary and secondary windings of the transformer to produce a signal in the secondary winding dependent on the size and composition of the coin;

said circuit comprising an oscillator to drive the primary winding of the transformer, and a demodulator to demodulate the oscillations in the secondary winding of the transformer to produce, in the no signal condition of the transformer, a steady voltage and, in the signal condition of said transformer, a voltage signal of an amplitude related to the steady voltage dependent on the size and composition of the coin;

said means for responding to said coin sensor signal comprising a timing network to produce a first operating signal and, on termination of said first operating signal, a second operating signal to effect operation of said first solenoid, and a third operating signal; and said means for responding to said detector signal comprising:

a comparator stage;

a capacitor one terminal of which is connected to a reference potential conductor of the circuit;

an analogue switch connected at a line input thereof to the output of said demodulator, at an operating input thereof to said timing network to receive said third operating signal from the timing network to open the switch and, at a line output thereof, to the other terminal of the capacitor;

an amplifier the input of which is connected to said other terminal of the capacitor and the output of which is connected to said comparator stage to provide a first steady reference voltage thereat to bias the comparator stage at the level of the signal amplitude corresponding to a particular coin denomination even when said capacitor is isolated from said demodulator on opening of said analogue switch;

a voltage follower stage receiving as an input, the output of said demodulator, and connected at its output to said comparator stage so that in the no signal condition of said transformer, the voltage follower stage provides a second steady reference voltage at the comparator stage to maintain together with said first steady reference voltage, a no signal condition at the output of the comparator stage, and so that in the signal condition of said transformer, the voltage follower stage feeds said voltage signal to the comparator stage to cause the latter, when the voltage signal amplitude is at least equal to said bias level, to produce a discrete output signal of a width substantially equal to the width of the peak of the voltage signal that would be produced by a coin of the particular denomination;

a peak generator connected to said demodulator to receive the output thereof and producing a control signal at the peak of said voltage signal; and an output logic connected at respective inputs to the output of said comparator stage and the output of said signal generator and producing an output signal signifying validation of a coin only when there is a coincidence in time of said control signal and said discrete signal from the comparator stage;

said amplifier comprising a field-effect transistor as the amplifier input stage with the gate of the transistor connected to said other terminal of said capacitor; and a voltage follower as the output stage of the amplifier.

2. An electronic coin validator as claimed in claim 1 wherein said line input of said switch is connected to said demodulator through an amplifier to effect the voltage drop across the source and gate electrodes of said field effect transistor.

3. An electronic coin validator comprising:

a coin chute to guide the coin through the validator;

(a) a coin-denomination detector to sense a coin passing along said chute and provide a signal indicative of the denomination of the coin;

(b) a first stop member located substantially immediately upstream of the detector and normally positioned to block said chute while being movable to permit the stop member to be withdrawn therefrom;

(c) a first solenoid for operation of said stop member to withdraw it from and return it to said chute;

(d) a coin sensor located adjacent said stop member to sense the arrival of a coin thereat and provide a signal indicating the fact; and (e) an electronic validator circuit comprising means for responding to said sensor signal to provide a signal to operate said solenoid, after a delay sufficient to allow the coin to come to rest on the stop member, to withdraw said stop member from said chute and permit the coin to move past said detector, and then to return the stop member to the chute, and means to respond to said detector signal to determine therefrom whether the coin giving rise to the signal is one of a selected denomination;

said coin denomination detector comprising a transformer the primary winding of which is arranged at one side of said chute and the secondary winding of which is arranged at the opposite side of said chute, so that a coin in passing along the chute passes between the primary and secondary windings of the transformer to produce a signal in the secondary winding dependent on the size and composition of the coin;

said circuit comprising an oscillator to drive the primary winding of the transformer, and a demodulator to demodulate the oscillations in the secondary winding of the transformer to produce, in the no signal condition of the transformer, a steady voltage and, in the signal condition of said transformer, a voltage signal of an amplitude related to the steady voltage dependent on the size and composition of the coin;

said means for responding to said coin sensor signal comprising a timing network to produce a first operating signal and, on termination of said first operating signal, a second operating signal to effect operation of said first solenoid, and a third operating signal; and said means for responding to said detector signal comprising:

a comparator stage;

a capacitor one terminal of which is connected to a reference potential conductor of the circuit;

an analogue switch connected at a line input thereof to the output of said demodulator, at an operating input thereof to said timing network to receive said third operating signal from the timing network to open the switch and, at a line output thereof, to the other terminal of the capacitor;

an amplifier the input of which is connected to said other terminal of the capacitor and the output of which is connected to said comparator stage to provide a first steady reference voltage thereat to bias the comparator stage at the level of the signal amplitude corresponding to a particular coin denomination even when said capacitor is isolated from said demodulator on opening of said analogue switch;

a voltage follower stage receiving as an input, the output of said demodulator, and connected at its output to said comparator stage so that in the no signal condition of said transformer, the voltage follower stage provides a second steady reference voltage at the comparator stage to maintain together with said first steady reference voltage, a no signal condition at the output of the comparator stage, and so that in the signal condition of said transformer, the voltage follower stage feeds said voltage signal to the comparator stage to cause the latter, when the voltage signal amplitude is at least equal to said bias level, to produce a discrete output signal of a width substantially equal to the width of the peak of the voltage signal that would be produced by a coin of the particular denomination;

a peak generator connected to said demodulator to receive the output thereof and producing a control signal at the peak of said voltage signal; and an output logic connected at respective inputs to the output of said comparator stage and the output of said signal generator and producing an output signal signifying validation of a coin only when there is a coincidence in time of said control signal and said discrete signal from the comparator stage;

said peak generator comprising an output logic gate having an input connected to said timing network to receive said second operating signal therefrom to inhibit the gate for the duration of that signal.

4. An electronic coin validator as claimed in claim 3, wherein said input of said signal generator output logic gate is connected to a terminal to permit a voltage source external of the validator to be connected thereto to inhibit operation of the gate.

5. An electronic coin validator comprising:

a coin chute to guide the coin through the validator;

(a) a coin-denomination detector to sense a coin passing along said chute and provide a signal indicative of the denomination of the coin;

(b) a first stop member located substantially immediately upstream of the detector and normally positioned to block said chute while being movable to permit the stop member to be withdrawn therefrom;

(c) a first solenoid for operation of said stop member to withdraw it from and return it to said chute;

(d) a coin sensor located adjacent said stop member to sense the arrival of a coin thereat and provide a signal indicating the fact; and (e) an electronic validator circuit comprising means for responding to said sensor signal to provide a signal to operate said solenoid, after a delay sufficient to allow the coin to come to rest on the stop member, to withdraw said stop member from said chute and permit the coin to move past said detector, and then to return the stop member to the chute, and means to respond to said detector signal to determine therefrom whether the coin giving rise to the signal is one of a selected denomination;

said coin denomination detector comprising a transformer the primary winding of which is arranged at one side of said chute and the secondary winding of which is arranged at the opposite side of said chute, so that a coin in passing along the chute passes between the primary and secondary windings of the transformer to produce a signal in the secondary winding dependent on the size and composition of the coin;

said circuit comprising an oscillator to drive the primary winding of the transformer, and a demodulator to demodulate the oscillations in the secondary winding of the transformer to produce, in the no signal condition of the transformer, a steady voltage and, in the signal condition of said transformer, a voltage signal of an amplitude related to the steady voltage dependent on the size and composition of the coin;

said means for responding to said coin sensor signal comprising a timing network to produce a first operating signal and, on termination of said first operating signal, a second operating signal to effect operation of said first solenoid, and a third operating signal; and said means for responding to said detector signal comprising:

a comparator stage;

a capacitor one terminal of which is connected to a reference potential conductor of the circuit;

an analogue switch connected at a line input thereof to the output of said demodulator, at an operating input thereof to said timing network to receive said third operating signal from the timing network to open the switch and, at a line output thereof, to the other terminal of the capacitor;

an amplifier the input of which is connected to said other terminal of the capacitor and the output of which is connected to said comparator stage to provide a first steady reference voltage thereat to bias the comparator stage at the level of the signal amplitude corresponding to a particular coin denomination even when said capacitor is isolated from said demodulator on opening of said analogue switch;

a voltage follower stage receiving as an input, the output of said demodulator, and connected at its output to said comparator stage so that in the no signal condition of said transformer, the voltage follower stage provides a second steady reference voltage at the comparator stage to maintain together with said first steady reference voltage, a no signal condition at the output of the comparator stage, and so that in the signal condition of said transformer, the voltage follower stage feeds said voltage signal to the comparator stage to cause the latter, when the voltage signal amplitude is at least equal to said bias level, to produce a discrete output signal of a width substantially equal to the width of the peak of the voltage signal that would be produced by a coin of the particular denomination;

a peak generator connected to said demodulator to receive the output thereof and producing a control signal at the peak of said voltage signal; and an output logic connected at respective inputs to the output of said comparator stage and the output of said signal generator and producing an output signal signifying validation of a coin only when there is a coincidence in time of said control signal and said discrete signal from the comparator stage;

said signal generator comprising:

a capacitor one terminal of which is connected to a circuit reference potential conductor and the other terminal of which is connected through a resistor to a circuit voltage line;

a first differential amplifier one input of which is connected to said other terminal of said capacitor, the output of which is connected through a diode to that input of the amplifier to form a feedback loop, and the second input of which is connected to the output of said demodulator;

a second differential amplifier one input of which is connected to said demodulator output and the other input of which is connected to the junction of said diode and said one input of said first differential amplifier;

and a differentiator the input of which is connected to the output of said second differential amplifier and the output of which is connected to the respective input of said output logic;

the arrangement being such that in the absence of said voltage signal a charge is maintained on said capacitor to keep the second differential amplifier output at a predetermined level, but such that, when said voltage signal is applied to the signal generator, the charge on said capacitor follows the signal voltage until the peak thereof and then varies its charge to restore its original charge at a lesser rate than the signal voltage changes whereby said second differential amplifier is switched to change its output level and operate the differentiator to produce a narrow pulse substantially coincident in time with the peak of said voltage signal;

said signal generator further comprising a normally open analogue switch connecting, when closed, said other terminal of said capacitor of the signal generator to a circuit voltage line and connected at an operating input to said timing network to receive said first operating signal therefrom to close the switch whereby, if the capacitor is not fully restored to its original charge from a previous operation when said first operating signal is again produced, the capacitor is connected through the switch to the circuit voltage line to restore the original charge during the period of the first operating signal.

6. An electronic coin validator comprising:

a coin chute to guide the coin through the validator;

(a) a coin-denomination detector to sense a coin passing along said chute and provide a signal indicative of the denomination of the coin;

(b) a first stop member located substantially immediately upstream of the detector and normally positioned to block said chute while being movable to permit the stop member to be withdrawn therefrom;

(c) a first solenoid for operation of said stop member to withdraw it from and return it to said chute;

(d) a coin sensor located adjacent said stop member to sense the arrival of a coin thereat and provide a signal indicating the fact; and (e) an electronic validator circuit comprising means for responding to said sensor signal to provide a signal to operate said solenoid, after a delay sufficient to allow the coin to come to rest on the stop member, to withdraw said stop member from said chute and permit the coin to move past said detector, and then to return the stop member to the chute, and means to respond to said detector signal to determine therefrom whether the coin giving rise to the signal is one of a selected denomination;

said coin denomination detector comprising a transformer the primary winding of which is arranged at one side of said chute and the secondary winding of which is arranged at the opposite side of said chute, so that a coin in passing along the chute passes between the primary and secondary windings of the transformer to produce a signal in the secondary winding dependent on the size and composition of the coin;

said circuit comprising an oscillator to drive the primary winding of the transformer, and a demodulator to demodulate the oscillations in the secondary winding of the transformer to produce, in the no signal condition of the transformer, a steady voltage and, in the signal condition of said transformer, a voltage signal of an amplitude related to the steady voltage dependent on the size and composition of the coin;

said means for responding to said coin sensor signal comprising a timing network to produce a first operating signal and, on termination of said first operating signal, a second operating signal to effect operation of said first solenoid, and a third operating signal; and said means for responding to said detector signal comprising:

a comparator stage;

a capacitor one terminal of which is connected to a reference potential conductor of the circuit;

an analogue switch connected at a line input thereof to the output of said demodulator, at an operating input thereof to said timing network to receive said third operating signal from the timing network to open the switch, and at a line output thereof, to the other terminal of the capacitor;

an amplifier the input of which is connected to said other terminal of the capacitor and the output of which is connected to said comparator stage to provide a first steady reference voltage thereat to bias the comparator stage at the level of the signal amplitude corresponding to a particular coin denomination even when said capacitor is isolated from said demodulator on opening of said analogue switch;

a voltage follower stage receiving as an input, the output of said demodulator, and connected at its output to said comparator stage so that in the no signal condition of said transformer, the voltage follower stage provides a second steady reference voltage at the comparator stage to maintain together with said first steady reference voltage, a no signal condition at the output of the comparator stage, and so that in the signal condition of said transformer, the voltage follower stage feeds said voltage signal to the comparator stage to cause the latter, when the voltage signal amplitude is at least equal to said bias level, to produce a discrete output signal of a width substantially equal to the width of the peak of the voltage signal that would be produced by a coin of the particular denomination;

a peak generator connected to said demodulator to receive the output thereof and producing a control signal at the peak of said voltage signal; and an output logic connected at respective inputs to the output of said comparator stage and the output of said signal generator and producing an output signal signifying validation of a coin only when there is a coincidence in time of said control signal and said discrete signal from the comparator stage;

said output logic comprising a third input; and connections being provided to connect the third input to a sensor mounted in relation to the coin chute to determine the diameter of a coin so that the output logic is enabled only if a signal condition is produced by said sensor indicating a diameter corresponding to a coin of said particular denomination.

7. An electronic coin validator comprising:

a coin chute to guide the coin through the validator;

(a) a coin-denomination detector to sense a coin passing along said chute and provide a signal indicative of the denomination of the coin;

(b) a first stop member located substantially immediately upstream of the detector and normally positioned to block said chute while being movable to permit the stop member to be withdrawn therefrom;

(c) a first solenoid for operation of said stop member to withdraw it from and return it to said chute;

(d) a coin sensor located adjacent said stop member to sense the arrival of a coin thereat and provide a signal indicating the fact; and (e) an electronic validator circuit comprising means for responding to said sensor signal to provide a signal to operate said solenoid, after a delay sufficient to allow the coin to come to rest on the stop member, to withdraw said stop member from said chute and permit the coin to move past said detector, and then to return the stop member to the chute, and means to respond to said detector signal to determine therefrom whether the coin giving rise to the signal is one of a selected denomination;

said coin denomination detector comprising a transformer the primary winding of which is arranged at one side of said chute and the secondary winding of which is arranged at the opposite side of said chute, so that a coin in passing along the chute passes between the primary and secondary windings of the transformer to produce a signal in the secondary winding dependent on the size and composition of the coin;

said circuit comprising an oscillator to drive the primary winding of the transformer, and a demodulator to demodulate the oscillations in the secondary winding of the transformer to produce, in the no signal condition of the transformer, a steady voltage and, in the signal condition of said transformer, a voltage signal of an amplitude related to the steady voltage dependent on the size and composition of the coin;

said means for responding to said coin sensor signal comprising a timing network to produce a first operating signal, and on termination of said first operating signal, a second operating signal to effect operation of said first solenoid, and a third operating signal; and said means for responding to said detector signal comprising:

a comparator stage;

a capacitor one terminal of which is connected to a reference potential conductor of the circuit;

an analogue switch connected at a line input thereof to the output of said demodulator, at an operating input thereof to said timing network to receive said third operating signal from the timing network to open the switch and, at a line output thereof, to the other terminal of the capacitor;

an amplifier the input of which is connected to said other terminal of the capacitor and the output of which is connected to said comparator stage to provide a first steady reference voltage thereat to bias the comparator stage at the level of the signal amplitude corresponding to a particular coin denomination even when said capacitor is isolated from said demodulator on opening of said analogue switch;

a voltage follower stage receiving as an input, the output of said demodulator, and connected at its output to said comparator stage so that in the no signal condition of said transformer, the voltage follower stage provides a second steady reference voltage at the comparator stage to maintain together with said first steady reference voltage, a no signal condition at the output of the comparator stage, and so that in the signal condition of said transformer, the voltage follower stage feeds said voltage signal to the comparator stage to cause the latter, when the voltage signal amplitude is at least equal to said bias level, to produce a discrete output signal of a width substantially equal to the width of the peak of the voltage signal that would be produced by a coin of the particular denomination;

a peak generator connected to said demodulator to receive the output thereof and producing a control signal at the peak of said voltage signal; and an output logic connected at respective inputs to the output of said comparator stage and the output of said signal generator and producing an output signal signifying validation of a coin only when there is a coincidence in time of said control signal and said discrete signal from the comparator stage;

said chute, downstream of said detector, dividing into a coin-accept channel and a coin-reject channel, and comprising a solenoid operated coin gate to guard the entrance to said coin-accept channel;

the solenoid of the gate being operated by said output signal from said output logic;

said circuit comprising an operating signal output comprising a first logic gate connected to said output logic stage and enabled by said output signal therefrom to provide an operating signal to operate the solenoid of said coin gate;

said output logic comprising, as the input stage thereto, a flip-flop connected at one input to said comparator stage to be switched in one direction by said discrete signal from said comparator stage;

said coin-accept channel having a coin sensor mounted in relation thereto to sense a coin after passing through said coin gate to provide a signal indicating the fact;

said circuit further comprising a reset circuit the input of which is connected to said coin accept sensor and the output of which is connected to the second input of said flip-flop so that the reset circuit responds to said signal from the coin-accept sensor to provide a signal to switch back said flip-flop and thereby remove the actuating signal from the solenoid of the coin gate; and said circuit comprising a feedback loop from said first logic gate; the feedback loop comprising a capacitor one terminal of which is connected to (1) said reset circuit so as to cause the reset circuit to produce said signal to reswitch said flip-flop when the charge on the capacitor assumes a predetermined level, and (2) also to the output of said first logic gate so that, when the latter is enabled, the charge on the capacitor is changed to achieve said predetermined charge thereon;

whereby the solenoid of said coin gate is deactivated even when a validated coin in respect of which the coin gate has opened, fails for some reason to pass through the gate and operate said coin-accept sensor.

8. An electronic coin validator comprising:

a coin chute to guide the coin through the validator;

(a) a coin-denomination detector to sense a coin passing along said chute and provide a signal indicative of the denomination of the coin;

(b) a first stop member located substantially immediately upstream of the detector and normally positioned to block said chute while being movable to permit the stop member to be withdrawn therefrom;

(c) a first solenoid for operation of said stop member to withdraw it from and return it to said chute;

(d) a coin sensor located adjacent said stop member to sense the arrival of a coin thereat and provide a signal indicating the fact; and (e) an electronic validator circuit comprising means for responding to said sensor signal to provide a signal to operate said solenoid, after a delay sufficient to allow the coin to come to rest on the stop member, to withdraw said stop member from said chute and permit the coin to move past said detector, and then to return the stop member to the chute, and means to respond to said detector signal to determine therefrom whether the coin giving rise to the signal is one of a selected denomination;

said coin denomination detector comprising a transformer the primary winding of which is arranged at one side of said chute and the secondary winding of which is arranged at the opposite side of said chute, so that a coin in passing along the chute passes between the primary and secondary windings of the transformer to produce a signal in the secondary winding dependent on the size and composition of the coin;

said circuit comprising an oscillator to drive the primary winding of the transformer, and a demodulator to demodulate the oscillations in the secondary winding of the transformer to produce, in the no signal condition of the transformer, a steady voltage and, in the signal condition of said transformer, a voltage signal of an amplitude related to the steady voltage dependent on the size and composition of the coin;

said means for responding to said coin sensor signal comprising a timing network to produce a first operating signal, and on termination of said first operating signal, a second operating signal to effect operation of said first solenoid, and a third operating signal; and said means for responding to said detector signal comprising:

a comparator stage;

a capacitor one terminal of which is connected to a reference potential conductor of the circuit;

an analogue switch connected at a line input thereof to the output of said demodulator, at an operating input thereof to said timing network to receive said third operating signal from the timing network to open the switch and, at a line output thereof, to the other terminal of the capacitor;

an amplifier the input of which is connected to said other terminal of the capacitor and the output of which is connected to said comparator stage to provide a first steady reference voltage thereat to bias the comparator stage at the level of the signal amplitude corresponding to a particular coin denomination even when said capacitor is isolated from said demodulator on opening of said analogue switch;

a voltage follower stage receiving as an input, the output of said demodulator, and connected at its output to said comparator stage so that in the no signal condition of said transformer, the voltage follower stage provides a second steady reference voltage at the comparator stage to maintain together with said first steady reference voltage, a no signal condition at the output of the comparator stage, and so that in the signal condition of said transformer, the voltage follower stage feeds said voltage signal to the comparator stage to cause the latter, when the voltage signal amplitude is at least equal to said bias level, to produce a discrete output signal of a width substantially equal to the width of the peak of the voltage signal that would be produced by a coin of the particular denomination;

a peak generator connected to said demodulator to receive the output thereof and producing a control signal at the peak of said voltage signal; and an output logic connected at respective inputs to the output of said comparator stage and the output of said signal generator and producing an output signal signifying validation of a coin only when there is a coincidence in time of said control signal and said discrete signal from the comparator stage;

said timing network providing an input to permit the network to be inhibited;

said input being connected to a circuit voltage through a switch so as normally to be provided with enabling voltage thereon, and said switch having an operating input by which, in response to an operating signal applied thereto, the switch is operated to provide an inhibiting voltage as said input of the timing network.

* * * * *